US009373309B2

(12) United States Patent
Koszegfalvi

(10) Patent No.: US 9,373,309 B2
(45) Date of Patent: Jun. 21, 2016

(54) STRINGED MUSICAL INSTRUMENT HAVING INLAID FRETBOARD AND METHOD OF MAKING THE SAME

(75) Inventor: Ferenc Koszegfalvi, Corona, CA (US)

(73) Assignee: Fender Musical Instruments Corporation, Scottsdale, AZ (US)

( * ) Notice: Subject to any disclaimer, the term of this patent is extended or adjusted under 35 U.S.C. 154(b) by 805 days.

(21) Appl. No.: 13/532,564

(22) Filed: Jun. 25, 2012

(65) Prior Publication Data

US 2013/0340591 A1 Dec. 26, 2013

(51) Int. Cl.
*G10D 3/06* (2006.01)
*G10D 1/08* (2006.01)

(52) U.S. Cl.
CPC .. *G10D 3/06* (2013.01); *G10D 1/08* (2013.01); *Y10T 29/49574* (2015.01)

(58) Field of Classification Search
CPC ..... G10D 3/06; G10D 1/08; G10D 1/00
USPC ..... 84/267, 290, 293
See application file for complete search history.

(56) References Cited

U.S. PATENT DOCUMENTS 4,137,813 A 2/1979 Stone et al.
4,237,944 A 12/1980 Todd, III et al.
5,436,602 A * 7/1995 McVeety ..... H01P 1/2056 333/206
5,631,432 A * 5/1997 Muncy ..... 84/293
5,864,073 A 1/1999 Carlson
6,011,205 A * 1/2000 Tucker ..... G10D 1/005 84/290
6,376,756 B1 4/2002 Beckmeier
6,774,292 B2 8/2004 Mace
7,767,890 B2 8/2010 Stein
7,786,361 B1 8/2010 Foltz
D626,991 S 11/2010 Jacob
8,138,404 B1 3/2012 Petros
2003/0106409 A1 * 6/2003 McPherson ..... 84/293
2009/0114076 A1 * 5/2009 Thidell ..... 84/314 R

* cited by examiner

*Primary Examiner* — Kimberly Lockett
(74) *Attorney, Agent, or Firm* — Robert D. Atkins; Patent Law Group: Atkins and Associates, P.C.

(57) ABSTRACT

A stringed musical instrument comprises a neck and a cavity formed in the neck. The cavity includes a curved bottom surface and a chamfer in a sidewall of the cavity. An island is formed in the cavity. A fretboard is formed comprising a veneer and adapted to fit the cavity. The fretboard includes an opening adapted to encompass the island in the cavity. The cavity or fretboard is formed using a computer-controlled or numerically-controlled milling machine, router, water jet, or laser. The fretboard is mounted within the cavity, and the island in the cavity is disposed within the opening in the fretboard. Mounting the fretboard within the cavity includes flexing a sidewall of the cavity. An edge of the fretboard contacts a sidewall of the cavity without a visible gap.

14 Claims, 14 Drawing Sheets

STRINGED MUSICAL INSTRUMENT HAVING INLAID FRETBOARD AND METHOD OF MAKING THE SAME

FIELD OF THE INVENTION

The present invention relates in general to musical instruments and, more particularly, to a stringed musical instrument including an inlaid fretboard and method of making the same.

BACKGROUND OF THE INVENTION

Guitars are stringed musical instruments used by amateur and professional musicians. Guitars include acoustic guitars which generally include a hollow body connected to a neck. The body includes a soundboard and backboard, with the soundboard typically including a centrally-located sound hole. The body further includes a bridge and tailpiece located near the end of the guitar opposite the neck which serve to anchor one end of the strings.

Guitars also include electric guitars which typically include a solid body connected to a neck. The body of an electric guitar includes pickups that generate or modulate an electrical signal in response to vibration of the strings and includes controls that select or modify the electrical signals. The body also includes a bridge and tailpiece to anchor one end of the strings.

The body of an acoustic guitar or electric guitar is connected to the neck of the guitar using a headblock. The neck includes a headstock at the end of the neck opposite the body. The headstock includes tuning keys or machine heads used to adjust and maintain the tension of the strings. The neck also includes the nut, a small strip of medium-hard material that supports the strings at the periphery of the headstock. In some instruments, the neck includes a truss rod disposed along the long axis of the neck and used to generate tension to counteract the tension placed on the neck by the strings. Typically the tension of the truss rod can be adjusted.

The neck also includes a fretboard or fingerboard disposed between the body and the nut. The fretboard spans the entire width of the neck and is mounted above a flat surface of the neck oriented towards the strings. The fretboard provides a surface upon which a person playing the instrument presses down the strings to adjust the effective length of the strings. Many other types of stringed musical instruments include a fretboard mounted to a neck including violas, violins, cellos, upright basses, ukuleles, fiddles, lutes, banjos, mandolins, dulcimers, and shamisens. On many instruments, the fretboard includes frets which permit the instrument to play a discrete scale of notes as determined by the spacing of the frets and the composition and tension of the strings. Alternatively, some instruments have a fretboard that does not have frets. Some instruments have a fretboard that includes decorative markings or markings to indicate the location where strings should be pressed to create particular notes. The markings on a fretboard can be inlays in the fretboard.

The fretboard must remain close to but not contact the unpressed strings along the entire length of the fretboard. The fretboard must not create any buzz, rattle, distortion or other undesirable vibrations. In addition, many players desire a particular tactile sensation when touching the fretboard. Finally, a fretboard has a substantial effect on the appearance of the instrument and are often designed to enhance the aesthetics of the instrument. Accordingly, some materials are highly desired as fretboard components, including exotic and difficult to obtain woods and expensive natural and synthetic materials.

Some materials that are desirable for a fretboard change dimension in response to changes in environmental factors such as temperature, humidity, pressure, or the moisture content of the material. Some materials change dimensions in response to surface treatments such as oiling or varnishing, for example, as when wood grain rises after application of a polyurethane finish. The changes in the dimensions can differ for different materials subjected to the same environmental changes or surface treatments. Using different materials together can therefore be difficult, in particular when a precise fit is desired or when the pieces being fitted together are relatively large or relatively thin.

SUMMARY OF THE INVENTION

A need exists for an inlaid fretboard in a musical instrument. Accordingly, in one embodiment, the present invention is a method of making a stringed musical instrument comprising providing a neck, forming a cavity in the neck, forming a fretboard adapted to fit the cavity, and mounting the fretboard within the cavity.

In another embodiment, the present invention is a stringed musical instrument comprising a neck, a cavity formed in the neck, and a fretboard disposed within the cavity and encompassed by sidewalls of the cavity.

In another embodiment, the present invention is a stringed musical instrument comprising a cavity formed in the stringed musical instrument and a fretboard disposed within the cavity.

In another embodiment, the present invention is a neck for a stringed musical instrument comprising a cavity formed in the neck and a fretboard disposed within the cavity.

DETAILED DESCRIPTION OF THE DRAWINGS

The present invention is described in one or more embodiments in the following description with reference to the figures, in which like numerals represent the same or similar elements. While the invention is described in terms of the best mode for achieving the invention's objectives, it will be appreciated by those skilled in the art that it is intended to cover alternatives, modifications, and equivalents as may be included within the spirit and scope of the invention as defined by the appended claims and their equivalents as supported by the following disclosure and drawings.

Figure 1A:
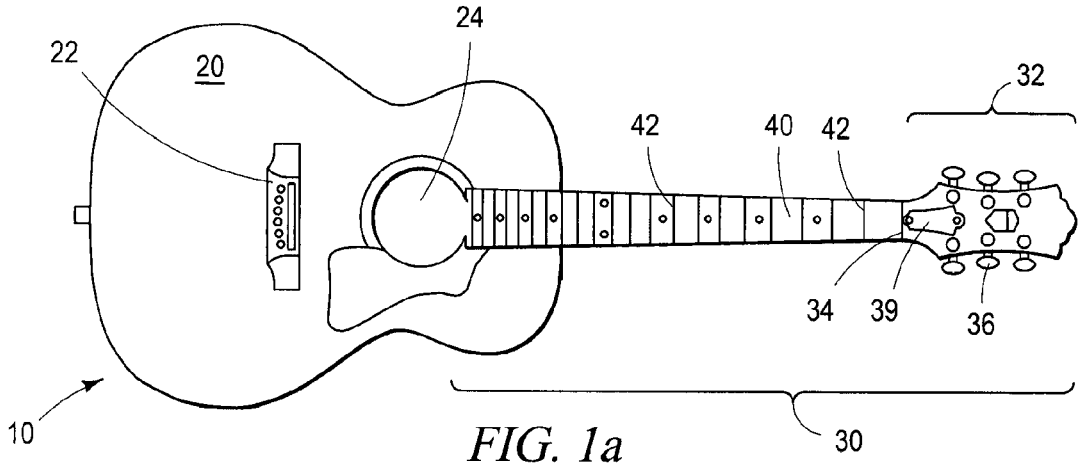
FIGS. 1*a*-1*d* illustrate an acoustic guitar.
Figure 1B:
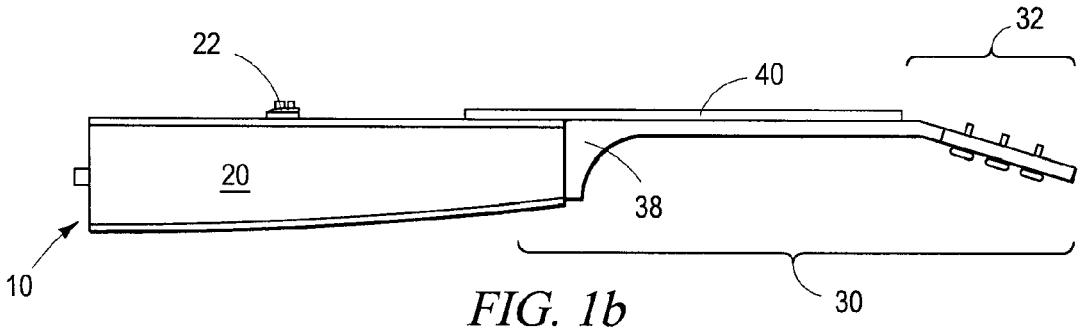

FIGS. 1*a* and 1*b* show plan and profile views of acoustic guitar 10 prior to being strung. Acoustic guitar 10 is a stringed musical instrument including body 20, neck 30, and one or more strings, typically six, strung from one end of the body to the opposite end of the neck. Body 20 of acoustic guitar 10 includes a tailstock and bridge 22 to anchor and support one end of the strings. Body 20 is hollow, and the air within the body resonates with the vibrations of the strings to provide acoustic amplification. The amplified vibrations exit body 20 via sound hole 24.

Neck 30 of acoustic guitar 10 is joined to body 20 by heel 38 and further includes headstock 32, nut 34, and fretboard 40. Headstock 32 includes tuning keys or machine heads 36 to anchor one end of the strings and adjust the tension of each string. Nut 34 is a small strip of medium-hard material mounted to neck 30 that supports the strings as the strings enter headstock 32.

Figure 1C:
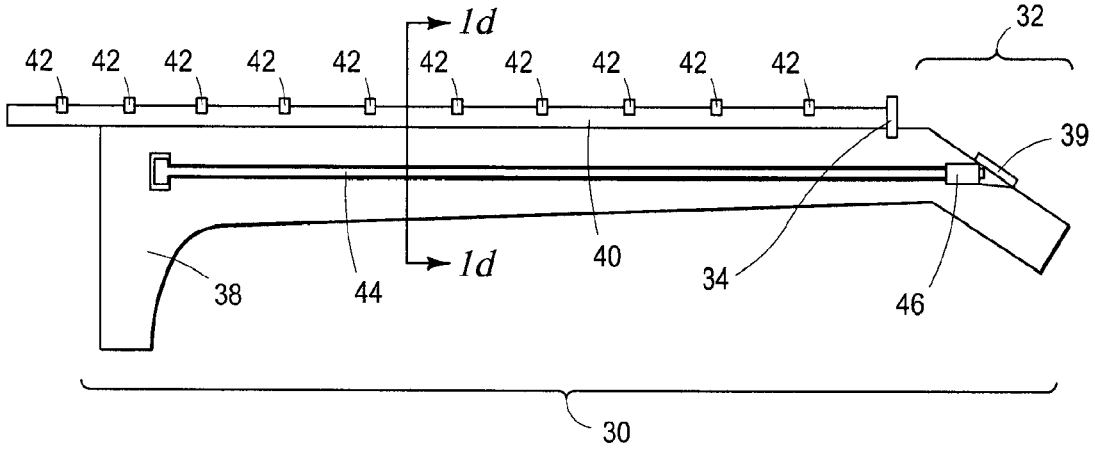

Headstock 32 includes truss rod cover 39. Truss rod cover 39 covers truss rod 44, a rod typically made of metal and running through neck 30 from headstock 32 towards heel 38, as shown in FIG. 1*c*. Truss rod 44 generates tension that counteracts the tension imposed on neck 30 by the strings. The tension generated by truss rod 44 is adjusted by using a tension adjustment mechanism 46 located under truss rod cover 39 or alternatively by using a tension adjustment mechanism located at the opposite end of the truss rod.

Figure 1D:
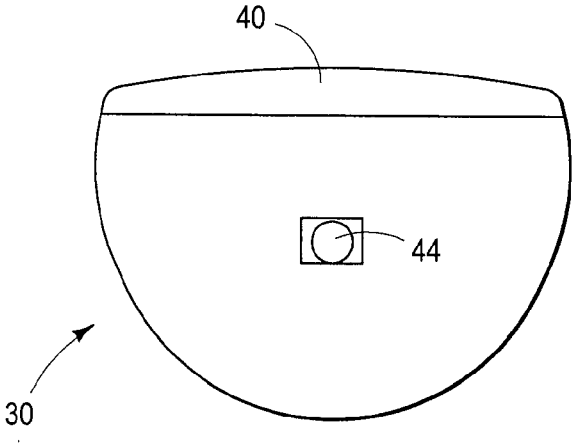

Fretboard 40 is disposed between headstock 32 and sound hole 24 on a surface of neck 30 oriented towards the strings. Fretboard 40 is mounted to a flat surface of neck 30 and spans the entire width of the neck as shown in FIG. 1*d*. Fretboard 40 allows the effective length of a string, i.e., the length of the string that vibrates when the string is plucked, bowed, or otherwise made to vibrate, to be altered by bringing the string in contact with the fretboard or with a fret 42 incorporated in the fretboard. Altering the effective length of the string alters the frequencies at which the string will vibrate. Frets 42 are raised elements of fretboard 40, such that when the strings are pressed down over fretboard 40, the strings first come in contact with frets 42. The point where a string contacts fret 42 determines the effective length of the string. Other stringed musical instruments that incorporate a fretboard include violas, violins, cellos, upright basses, ukuleles, fiddles, lutes, banjos, mandolins, dulcimers, and shamisens. Alternatively, some stringed instruments have a fretboard without frets wherein the string when pressed contacts the surface of the fretboard.

Figure 2:
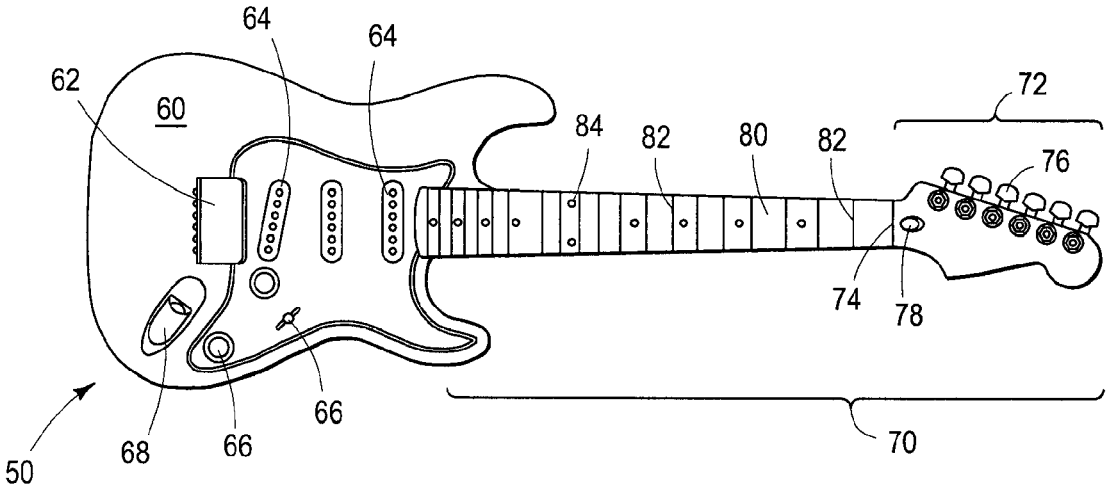
FIG. 2 illustrates an electric guitar.

FIG. 2 shows electric guitar 50 prior to being strung. Electric guitar 50 includes body 60, neck 70, and strings strung from the body to the opposite end of the neck. Some electric guitars further include a second neck disposed approximately parallel to the first neck. Electric guitars typically employ four to seven strings, but can employ as many as twelve strings or more. Body 60 of electric guitar 50 is typically solid and includes a tailstock and bridge 62 to anchor and support one end of the strings. Electrical signals are produced in pickups 64 as a result of the vibration of the strings. The electrical signals are selected or modified according to controls 66 and sent to an external amplifier through output connector 68.

Neck 70 of electric guitar 50 includes headstock 72, nut 74, and fretboard 80. Headstock 72 includes machine heads 76 to anchor one end and adjust the tension of each string. Nut 74 is a small strip of medium-hard material mounted to neck 70 that supports the strings as the strings enter headstock 72. Headstock 72 also includes truss rod cover 78. Truss rod cover 78 covers the truss rod, a rod typically made of metal and running through neck 70 from headstock 72 towards the junction of the neck with body 60, similar to truss rod 44 of acoustic guitar 10 shown in FIG. 1*c*. The truss rod generates tension that counteracts the tension imposed on neck 70 by the strings. The truss rod tension is adjusted by using an adjustment mechanism under truss rod cover 78 or by using an adjustment mechanism at the opposite end of the truss rod.

Fretboard 80 is disposed between body 60 and nut 74. Fretboard 80 is mounted on a flat surface of neck 70 oriented towards the strings and spans the entire width of the neck. Fretboard 80 allows the effective length of a string to be altered by bringing the string in contact with the fretboard or with a fret 82 incorporated in the fretboard. Altering the effective length of the string alters the frequencies at which the string will vibrate. Frets 82 are raised elements of fretboard 80. When the strings are pressed down over fretboard 80, the strings first come in contact with frets 82, thus determining the effective length of the string. Fretboard 80 also includes fret markers 84 to guide players to the correct locations to press to create particular notes.

Figure 3A:
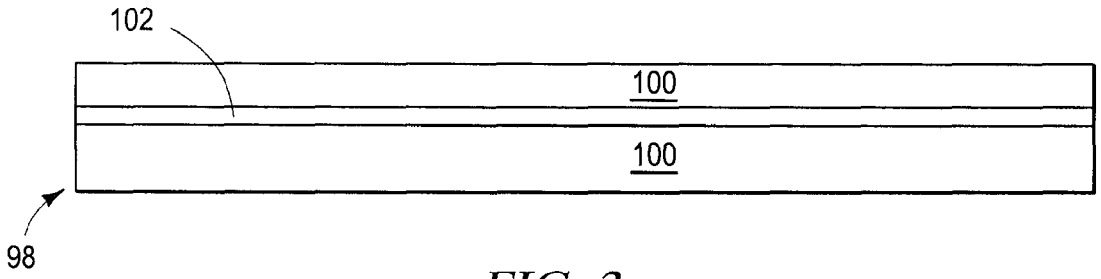
FIGS. 3*a*-3*r* illustrate a process of making a neck having an inlay for a fretboard in a stringed musical instrument.
Figure 3B:
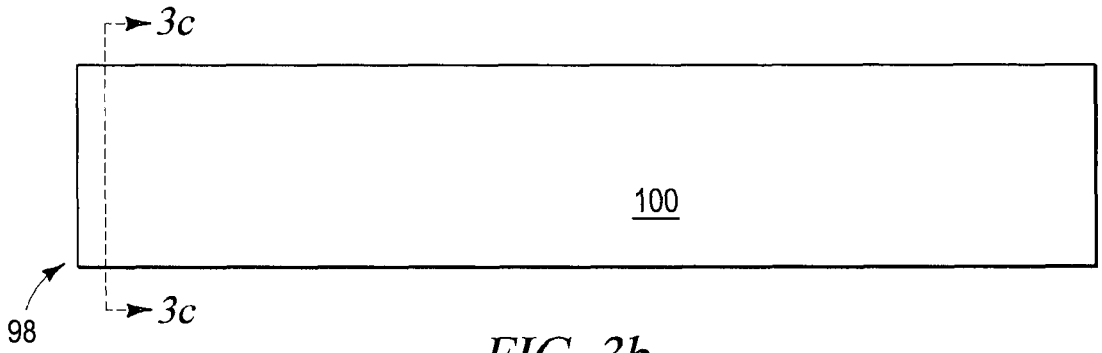
Figure 3C:
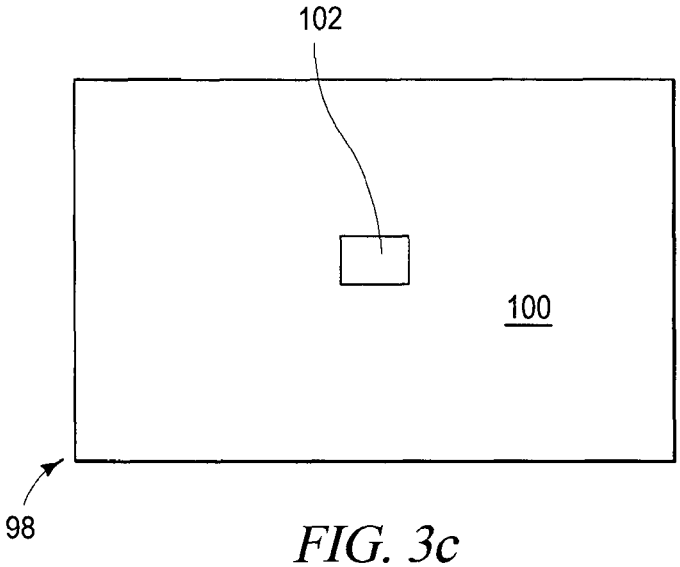
Figure 3D:
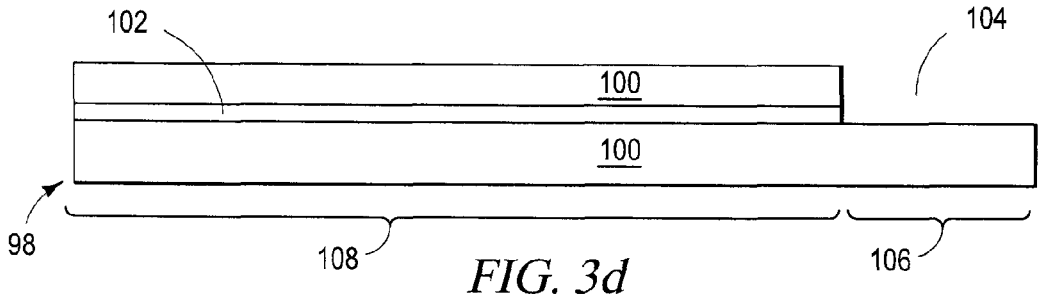
Figure 3E:
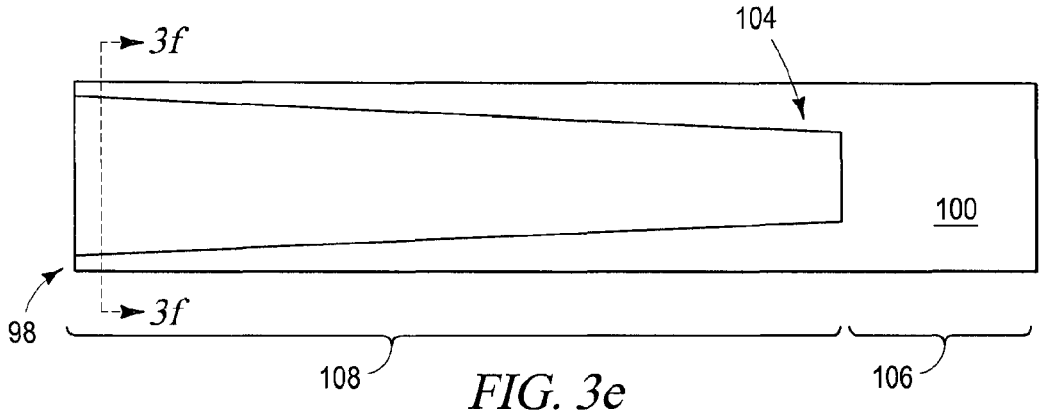
Figure 3F:
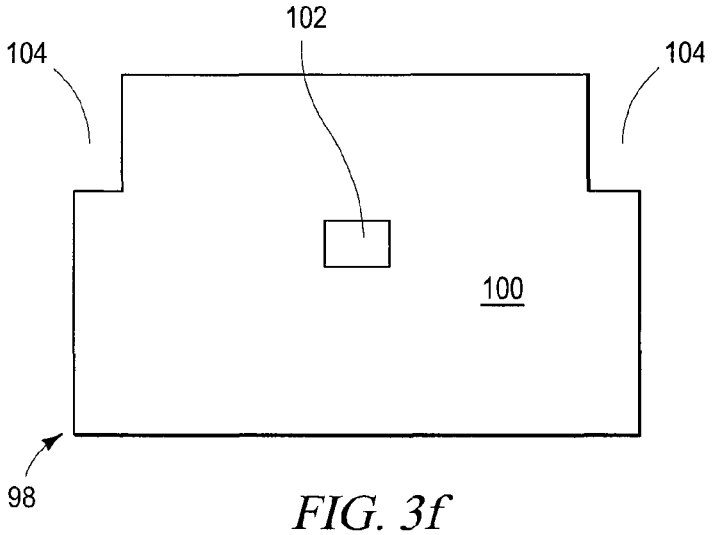
Figure 3G:
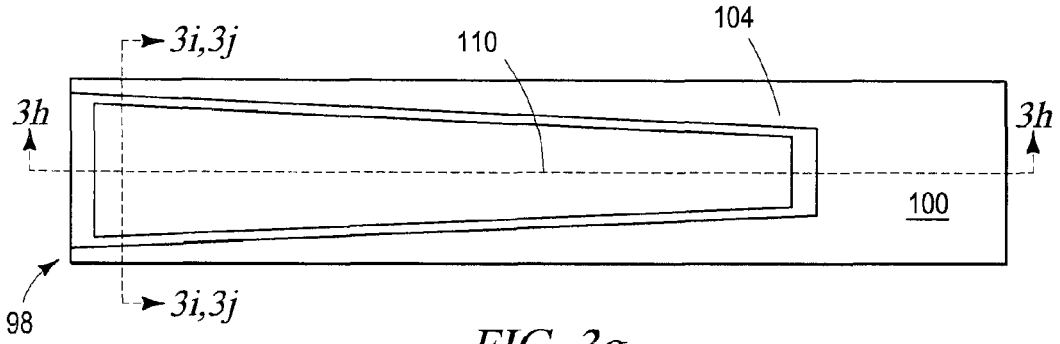
Figure 3H:
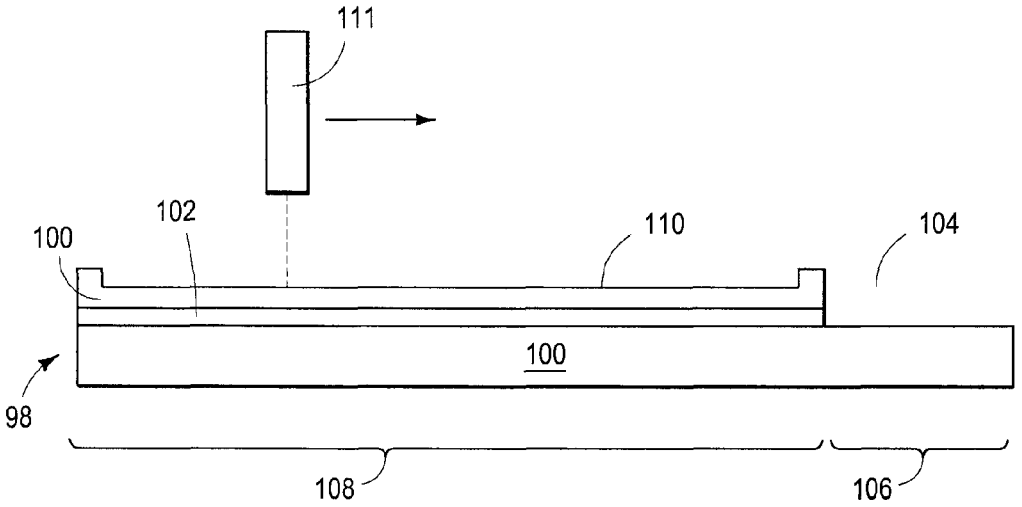
Figure 3I:
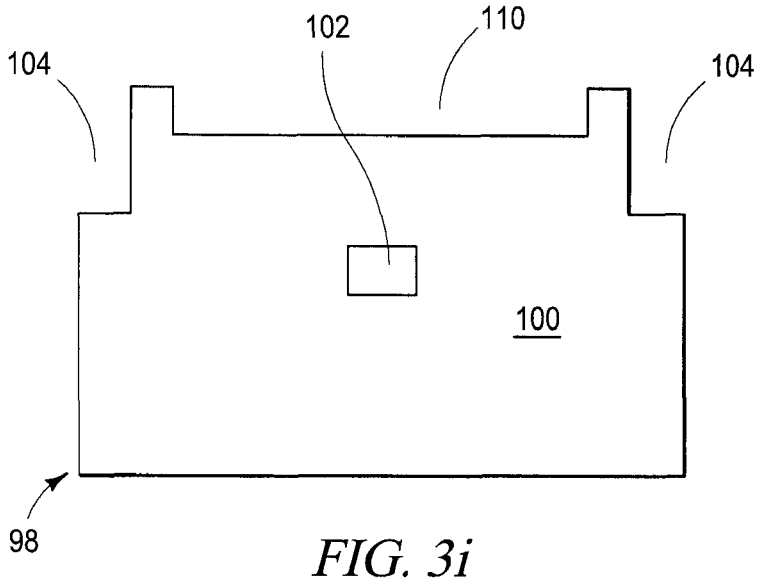
Figure 3J:
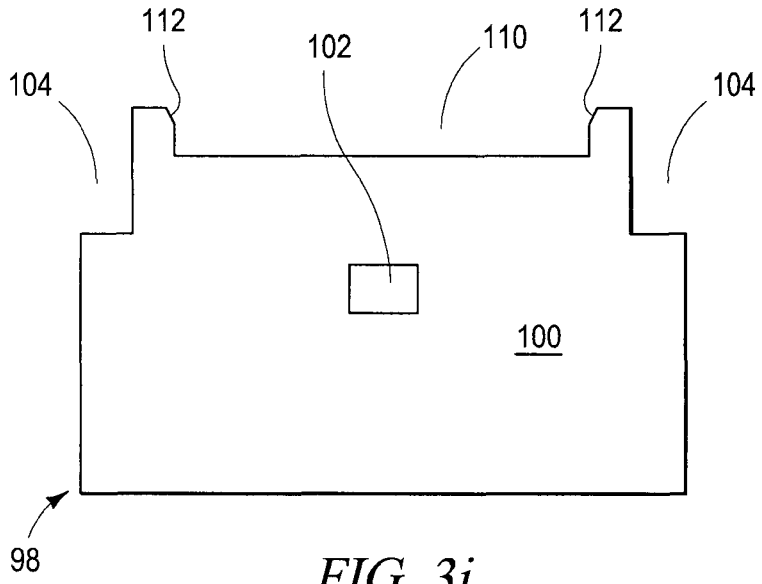
Figure 3K:
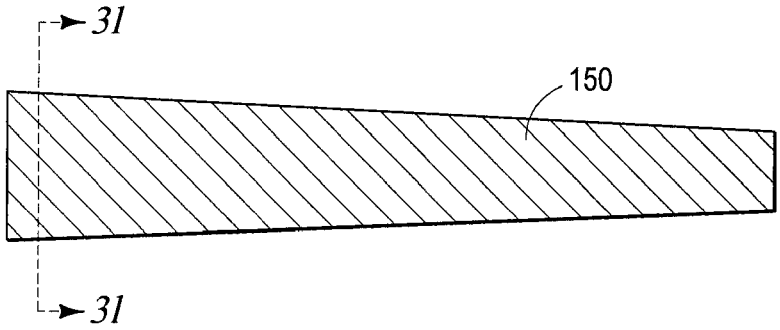
Figure 31:
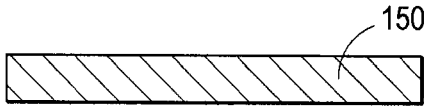
Figure 3M:
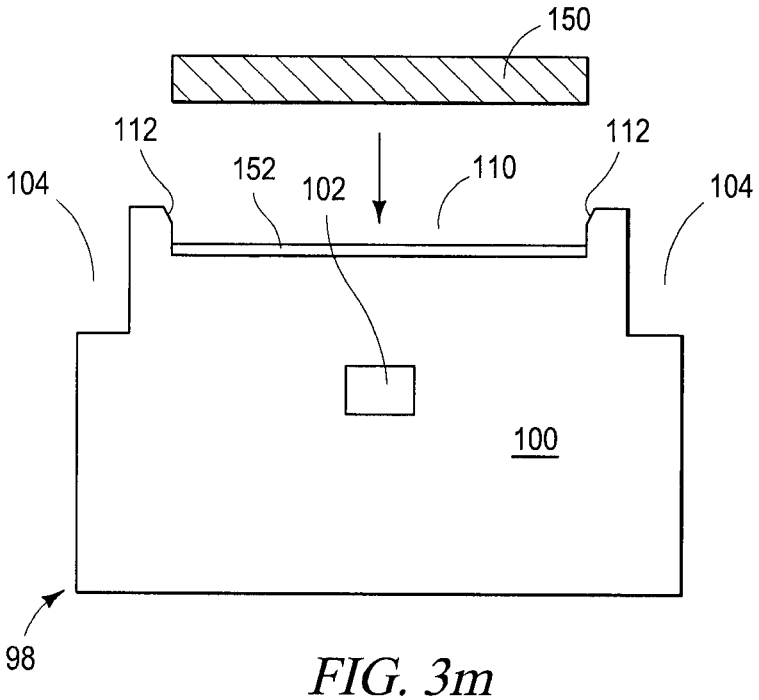
Figure 3N:
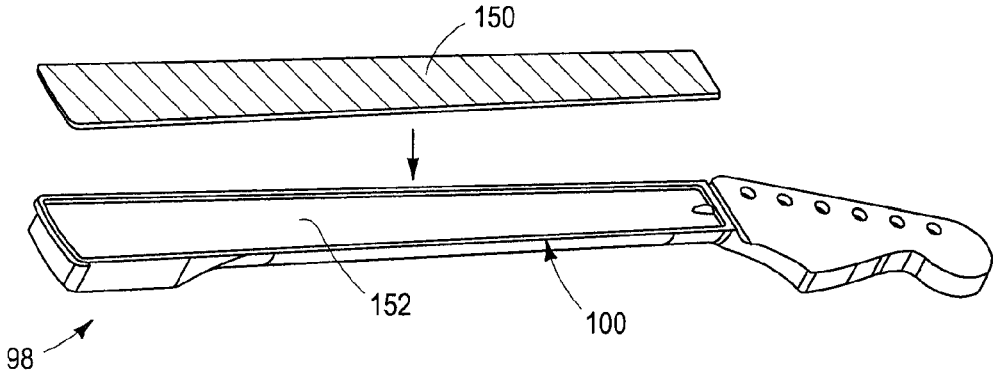
Figure 3O:
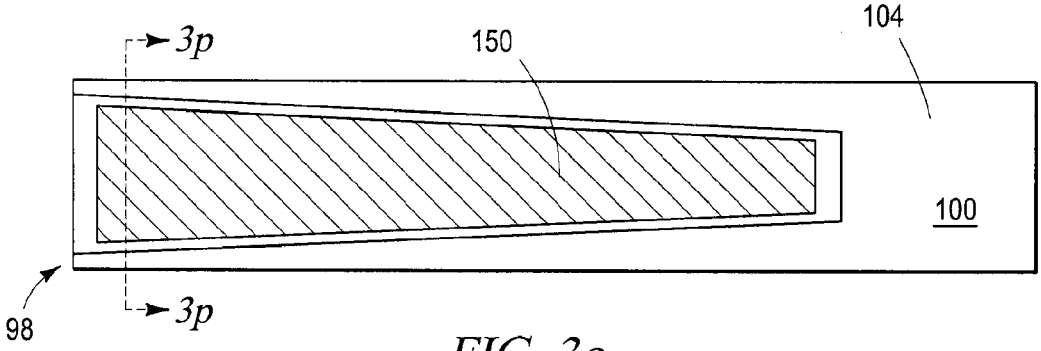
Figure 3P:
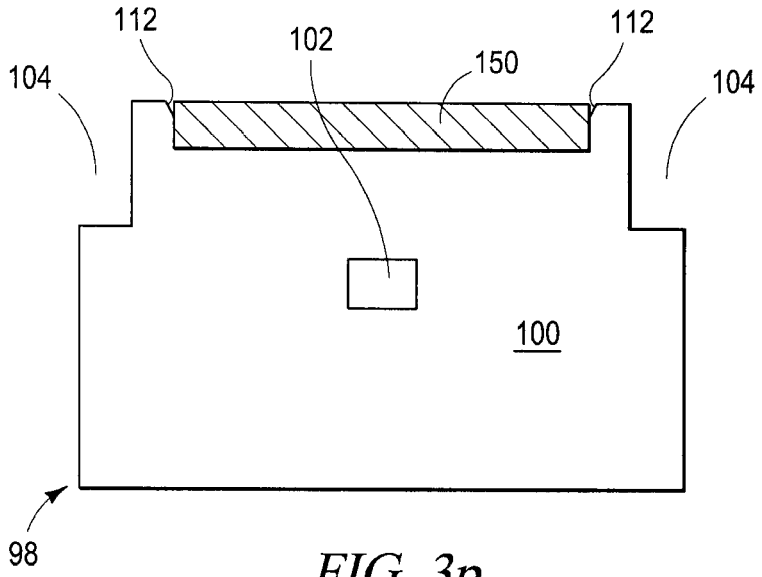
Figure 3Q:
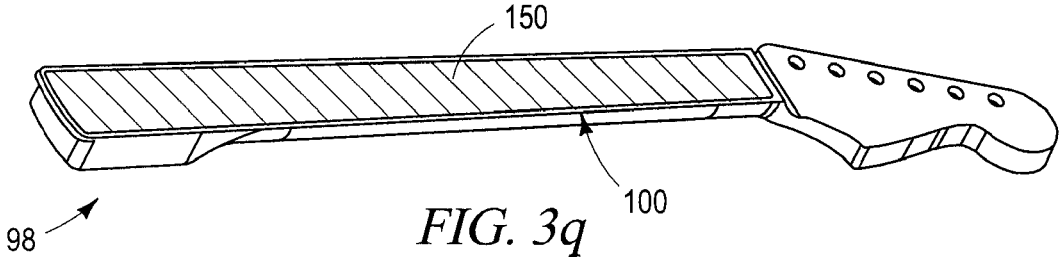
Figure 3R:
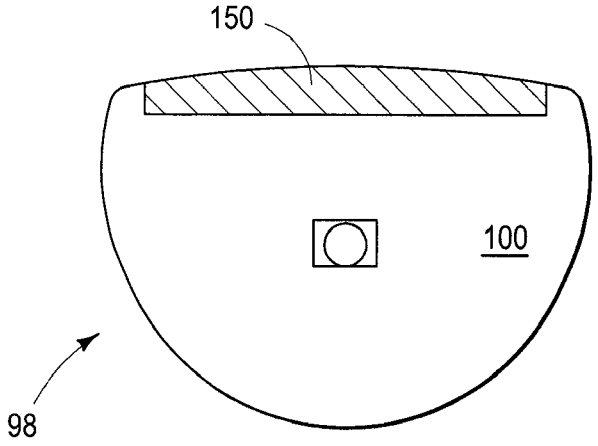

FIGS. 3*a*-3*r* show a method of making a stringed musical instrument neck including an inlaid fretboard. In FIG. 3*a*, neck 98 includes neck back 100 and truss rod channel 102. FIGS. 3*b* and 3*c* show plan and cross-section views of neck 98, respectively. In one embodiment, neck back 100 is a single piece of material. In another embodiment, neck back 100 is formed by joining together subcomponents, such as by joining together blocks or layers of similar or dissimilar materials. Materials used to form neck back 100 can include wood such as maple, mahogany, walnut, black cherry, bubing a, ebony, korina, koa, purpleheart, rosewood, wenge, and spanish cedar. The materials used to form neck back 100 can also include metal, ceramics, glass, polymers, and fiberglass or carbon fiber composites.

Truss rod channel 102 is adapted to receive a truss rod and formed in neck back 100 by a material shaping process such as drilling, routing, milling, laser cutting, molding, and combinations thereof. In an alternative embodiment, truss rod channel 102 is formed in one or more subcomponents of neck back 100 by a material shaping process such drilling, routing, milling, slicing, sawing, laser cutting, molding, stamping, and combinations thereof before joining the subcomponents together to form neck back 100.

In one embodiment of neck back 100 including wood, the wood is selected for species, place of origin, location within the source log, color, grain orientation, straightness and density of grain, figure, spalting, or the presence or absence of inclusions such as bird's eye, burl, or knots that affect the appearance or material characteristics of the wood. In one embodiment of neck back 100 including wood, the wood is selected or processed to obtain a desired moisture content or to crystallize resins within the wood, such as by drying the wood in a kiln or storing the wood for an extended period of time in a controlled environment. In one embodiment of neck back 100 including wood, the wood is bleached, dyed, or steamed or is impregnated with a preservative or hardener.

In FIG. 3*d*, neck back 100 is partially shaped by removing material from region 104 using a material removal process such as drilling, routing, milling, rabbeting, chiseling, scraping, sawing, laser cutting, and combinations thereof. Material is removed from region 106 as part of the formation of the headstock. Material is removed from region 108 in preparation for receiving the fretboard as discussed in further detail below. In one embodiment, a portion of neck back 100 is temporarily left unshaped or is shaped to accommodate a fixture for securing the neck during subsequent operations. In an alternative embodiment, material is removed from neck back 100 to produce a shape closer to the final shape of the neck. FIGS. 3*e* and 3*f* show plan and cross-section views of neck 98, respectively, after the shaping shown in FIG. 3*d*.

In FIG. 3*g*, cavity 110 adapted to receive a fretboard is formed in neck back 100 using a material removal process such as drilling, routing, milling, rabbeting, chiseling, scraping, sawing, laser cutting, and combinations thereof. FIGS.

3*h* and 3*i* show cross-sections of neck 98 including cavity 110. In one embodiment, cavity 110 is formed using a high-precision process such as using a computer-controlled (CNC) or numerically-controlled (NC) milling machine, CNC or NC router, CNC or NC laser cutter 111, or combinations thereof. CNC and NC machines are capable of accurately and precisely shaping material and can be programmed to form an object so the object precisely mates with another object formed by the same or another CNC or NC machine. In one embodiment, cavity 110 is formed including a flat bottom as shown in FIGS. 3*h* and 3*i*. In one embodiment, sidewalls of cavity 110 are perpendicular to the bottom of the cavity.

FIG. 3*j* shows an embodiment of neck back 100 further including chamfers 112 formed along sidewalls of cavity 110. Chamfers 112 are adapted to facilitate inlaying a fretboard into cavity 110 as discussed in detail below. In one embodiment chamfers 112 are formed prior to forming cavity 110 by forming v-shaped grooves in neck 98 using a process such as carving, chiseling, routing, milling, laser cutting, and combinations thereof. In an alternative embodiment, chamfers 112 are formed while forming cavity 110. In another alternative embodiment, chamfers 112 are formed after forming cavity 110 using a process such as sanding, filing, routing, milling, cutting, laser cutting, and combinations thereof to remove material from sidewalls of the cavity.

FIGS. 3*k* and 3*l* show fretboard 150 in plan and cross-section views, respectively. Fretboard 150 is formed from materials such as wood, metal, glass, ceramic, polymer, and fiberglass or carbon fiber composite. In an embodiment of fretboard 150 including wood, woods typically used include rosewood, ebony, maple, and pau ferro. Fretboard 150 is formed using a process such as planing, drilling, routing, milling, rabbeting, chiseling, scraping, sawing, sanding, molding, stamping, and combinations thereof. In one embodiment, fretboard 150 is formed using a process including using a CNC or NC milling machine, CNC or NC router, CNC or NC water jet, or CNC or NC laser. CNC or NC machines are capable of accurately and precisely shaping material, and can be programmed to form an object so the object precisely mates with another object formed by the same or another CNC or NC machine. In one embodiment, fretboard 150 is formed including slots adapted to receive frets.

In one embodiment of fretboard 150 including wood, the wood is selected for species, place of origin, location within the source log, color, grain orientation, straightness and density of grain, figure, spalting, or the presence or absence of inclusions such as bird's eye, burl, or knots that affect the appearance or material characteristics of the wood. In one embodiment of fretboard 150 including wood, the wood is selected or processed to obtain a desired moisture content or to crystallize resins within the wood, such as by drying the wood in a kiln or storing the wood for an extended period of time in a controlled environment. In one embodiment of fretboard 150 including wood, the wood is bleached or steamed. In one embodiment of fretboard 150 including wood, the wood is impregnated with a preservative or hardener or finished with a dye, stain, sealer, varnish, or other surface treatment prior to being joined to neck back 100.

In FIGS. 3*m* and 3*n*, fretboard 150 is positioned over neck back 100 from FIGS. 3*a*-3*j*. Adhesive 152 suitable for joining fretboard 150 to neck back 100 is applied within cavity 110. Alternatively, adhesive 152 is applied to surfaces of fretboard 150 or to both the fretboard and neck back 100. In one embodiment, fretboard 150 and neck back 100 include wood and adhesive 152 includes hide glue, urea-formaldehyde resin, resorcinol-formaldehyde resin, polyvinyl acetate, aliphatic resin emulsion, polyurethane, or epoxy.

Fretboard 150 and neck back 100 are moved one towards the other, and chamfers 112 help align the fretboard within cavity 110. In one embodiment, portions of neck back 100 surrounding cavity 110 deform or flex so as to facilitate the entry of fretboard 150 into the cavity. Fretboard 150 is disposed within cavity 110 in contact with the bottom and sides of the cavity, as shown in FIGS. 3*o*-3*q* showing neck 98 with fretboard 150 inlaid within the cavity in plan, cross-section, and perspective view, respectively. In one embodiment, fretboard 150 and neck back 100 are held together by bands, clamps, or other means while adhesive 152 sets or cures, and the bands, clamps, or other means are removed after the adhesive obtains sufficient bond strength. In one embodiment, fretboard 150 has a different moisture content than neck back 100 when the fretboard and neck back are joined so that the fretboard will subsequently swell or the neck back subsequently shrink so that the fretboard more precisely fills cavity 110. In another embodiment, fretboard 150 has a different temperature than neck back 100 when the fretboard and neck back are joined so that the fretboard will subsequently expand or the neck back subsequently shrinks so that the fretboard more precisely fills cavity 110.

FIG. 3*r* shows a cross-section of neck 98 after further shaping of the neck. Neck back 100 is shaped into a finished profile by a material removal process such as planning, drilling, routing, milling, rabbeting, chiseling, scraping, sawing, sanding, and combinations thereof. Chamfers 112 are eliminated while fretboard 150 and adjacent portions of neck back 100 are shaped into a suitably radiused surface by a material removal process such as milling, chiseling, scraping, sawing, sanding, and combinations thereof. In one embodiment, grooves adapted to receive frets are formed in fretboard 150 using a CNC or NC end mill, router, or laser cutting system after joining the fretboard to neck back 100. In one embodiment, neck 98 or portions thereof are given a surface coating or finish appropriate to the materials used.

Figure 4:
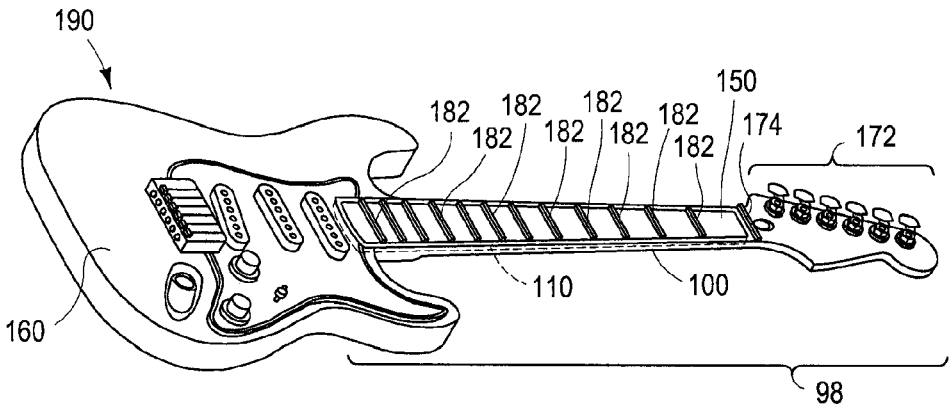
FIG. 4 illustrates a guitar with a neck having an inlay for a fretboard in accordance with FIGS. 3*a*-3*r;*

FIG. 4 shows guitar 190 incorporating neck 98 made using the process shown in FIGS. 3*a*-3*r*. Neck 98 is joined to body 160 and includes headstock 172, nut 174, and fretboard 150. Fretboard 150 is mounted in cavity 110 formed in neck back 100 with an exposed surface of the fretboard oriented away from the neck back. Sidewalls of cavity 110 encompass fretboard 150, that is to say, the surfaces of the fretboard perpendicular to the exposed surface of the fretboard are concealed by the sidewalls of the cavity. A surface of neck back 100 at the periphery of cavity 110 is flush with the exposed surface of fretboard 150. Frets 182 are mounted on fretboard 150. In an alternative embodiment, fretboard 150 is devoid of frets. In one embodiment, frets 182 span the entire width of neck 98. In an alternative embodiment, frets 182 span no more than the width of fretboard 150. By carefully selecting, preparing and forming the materials used in neck back 100 and fretboard 150 and by precision shaping of fretboard 150 and cavity 110, neck 98 made using the method of FIGS. 3*a*-3*r* does not have a visible gap between the neck back and fretboard. Furthermore, neck 98 made using the method of FIGS. 3*a*-3*r* has fretboard 150 that does not have a visible edge when viewing the neck from the side. In addition, the method of FIGS. 3*a*-3*r* allows the use of materials for fretboard 150 unsuitable for use in a non-inlaid fretboard, for example, materials that lacked the hardness or transverse tensile strength necessary to maintain an exposed edge or corner during use of the guitar, or materials with only one aesthetically-acceptable surface.

Figure 5A:
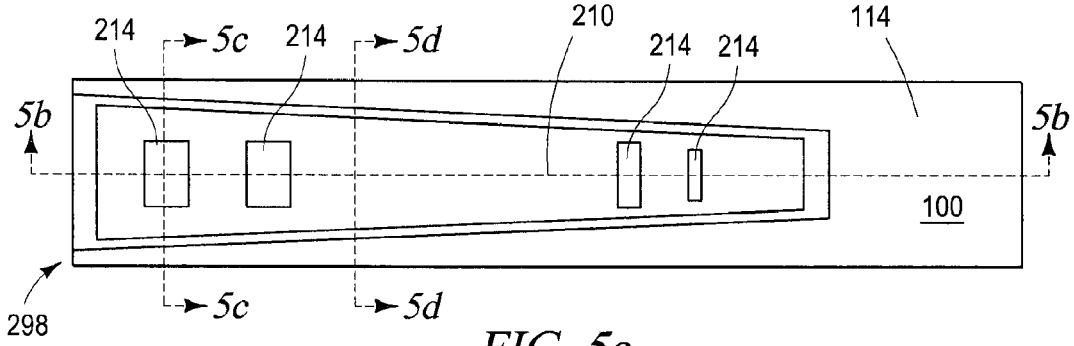
FIGS. 5*a*-5*h* illustrate a process of making a neck having an inlay for a fretboard in accordance with FIGS. 3*a*-3*f;*
Figure 5B:
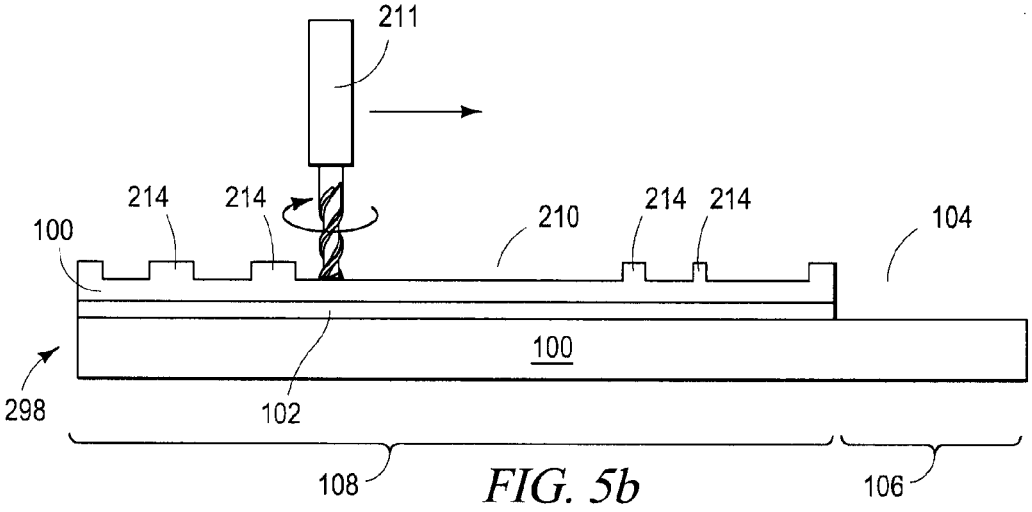
Figure 5C:
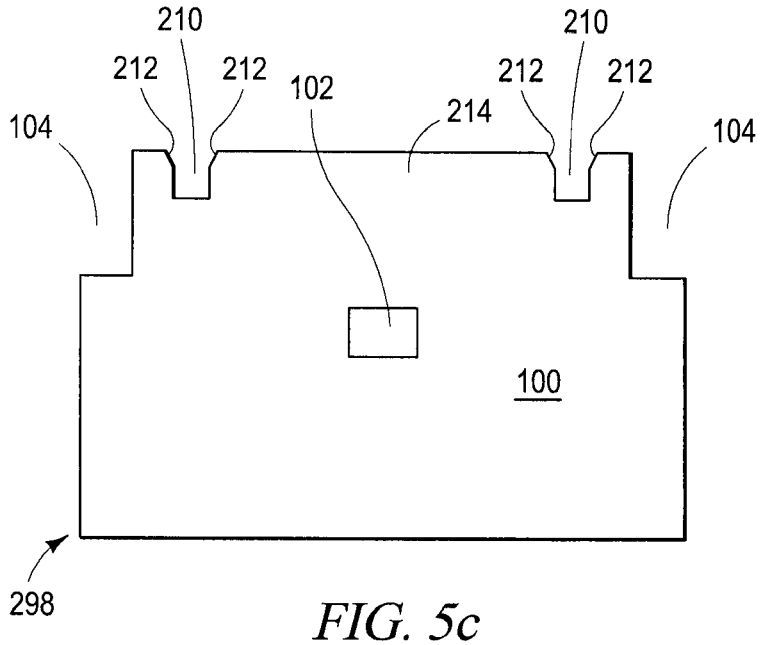
Figure 5D:
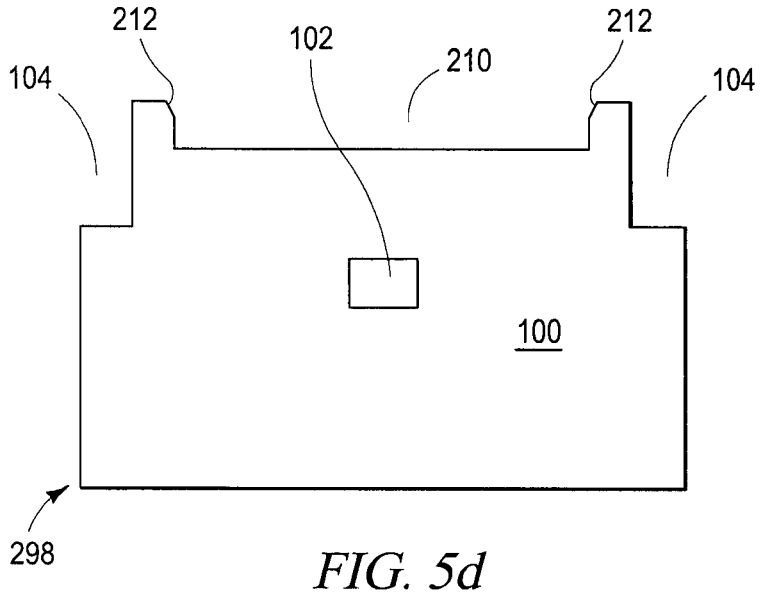

FIGS. 5*a*-5*h* in conjunction with FIGS. 3*a*-3*f* show an alternative embodiment of a method of making a stringed musical instrument neck including an inlaid fretboard further including portions of the neck back being inset in the fretboard. Continuing from FIG. 3*f*, in FIG. 5*a* cavity 210 adapted to receive a fretboard is formed in neck back 100 using a material removal process such as drilling, routing, milling, rabbeting, chiseling, scraping, sawing, laser cutting, and combinations thereof. Cavity 210 includes islands 214 of material that was not removed. FIGS. 5*b*-5*d* show cross-sections of neck back 100 including cavity 210 and islands 214. In one embodiment, cavity 210 is formed using a high-precision process such as using a CNC or NC milling machine 211, CNC or NC router, CNC or NC laser cutter, or combinations thereof. In one embodiment, cavity 210 is formed including a flat bottom as shown in FIGS. 5*b*-5*d*.

FIGS. 5*c* and 5*d* show an embodiment of neck back 100 further including chamfers 212 formed in sidewalls of cavity 210. Chamfers 212 are adapted to facilitate inlaying a fretboard into cavity 210 as discussed in detail below. In one embodiment chamfers 212 are formed prior to forming cavity 210 by forming v-shaped grooves in neck back 100 using a process such as carving, chiseling, routing, milling, laser cutting, and combinations thereof. In an alternative embodiment, chamfers 212 are formed while forming cavity 210. In another alternative embodiment, chamfers 212 are formed after forming cavity 210 by using sanding, filing, routing, milling, cutting, laser cutting, or combinations thereof to remove material from sidewalls of the cavity.

Figure 5E:
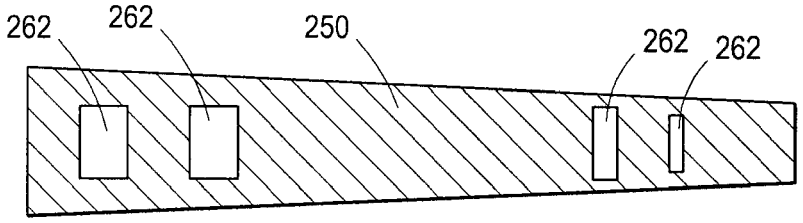

In FIG. 5*e*, fretboard 250 includes openings 262 adapted to accommodate islands 214 of neck back 100. Fretboard 250 includes materials such as wood, metal, glass, ceramics, polymers, and fiberglass or carbon fiber composites. In an embodiment of fretboard 250 including wood, woods typically used include rosewood, ebony, maple, and pau ferro. Fretboard 250 is formed by a process such as planing, drilling, routing, milling, rabbeting, chiseling, scraping, sawing, sanding, molding, stamping, and combinations thereof. In one embodiment, fretboard 250 is formed using a high-precision process such as using a CNC or NC milling machine, CNC or NC router, CNC or NC water jet, CNC or NC laser cutter, or combinations thereof. In one embodiment, fretboard 250 is formed including slots adapted to receive frets.

Figure 5F:
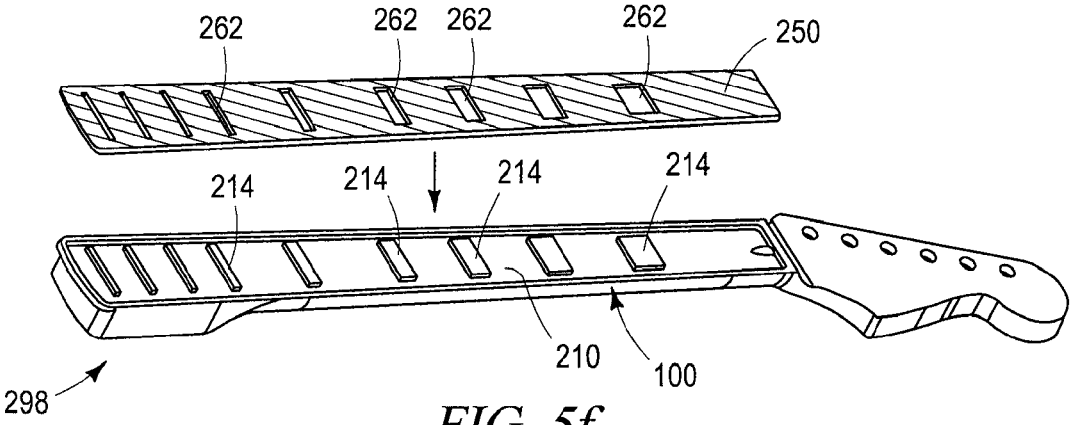

In FIG. 5*f*, fretboard 250 is positioned over neck back 100 from FIGS. 5*a*-5*d*. An adhesive suitable for joining fretboard 250 to neck back 100 is applied within cavity 210. Alternatively, an adhesive is applied to surfaces of fretboard 250 or to both the fretboard and neck back 100. In one embodiment, fretboard 250 and neck back 100 include wood and the adhesive includes hide glue, urea-formaldehyde resin, resorcinol-formaldehyde resin, polyvinyl acetate, aliphatic resin emulsion, polyurethane, or epoxy.

Figure 5G:
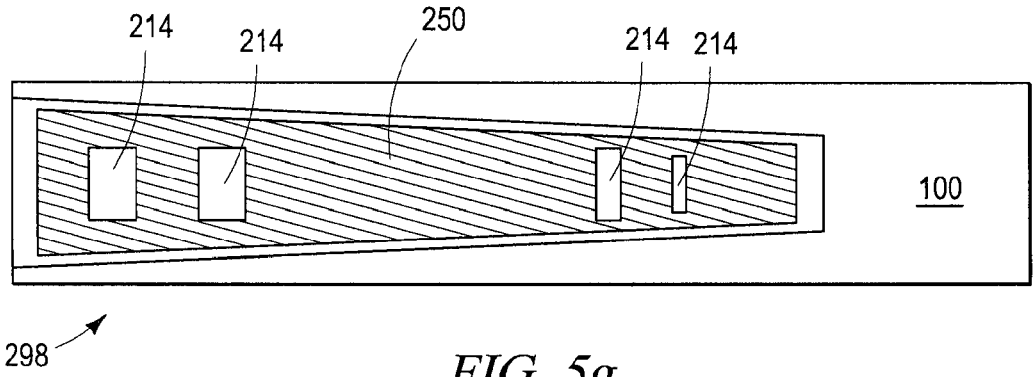
Figure 5H:
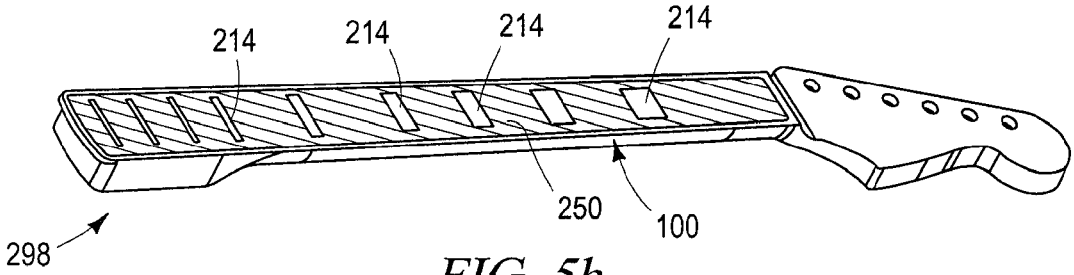

Fretboard 250 and neck back 100 are moved one towards the other, and chamfers 212 help align the fretboard within cavity 210. In one embodiment, portions of neck back 100 surrounding cavity 210 are thin enough to deform or flex so as to facilitate the entry of fretboard 250 into the cavity. Fretboard 250 is disposed within cavity 110 in contact with the bottom and sides of the cavity and around islands 214, as shown in FIGS. 5*g* and 5*h* showing neck 298 with the fretboard inlaid within the cavity and around the islands in plan and perspective view, respectively. In one embodiment, fretboard 250 and neck back 100 are held together by bands, clamps, or other means while the adhesive sets or cures, and the bands, clamps, or other means are removed after the adhesive obtains sufficient bond strength. In one embodiment, fretboard 250 has a different moisture content than neck back 100 when the fretboard and neck back are joined so that the fretboard will subsequently swell or the neck back subsequently shrinks so that the fretboard more precisely fills cavity 210. In another embodiment, fretboard 250 has a different temperature than neck back 100 when the fretboard and neck back are joined so that the fretboard will subsequently expand and/or the neck back subsequently shrinks so that the fretboard more precisely fills cavity 210. Neck 298 is subsequently processed into its finished form in a manner similar to that shown in FIG. 3*r*.

Figure 6:
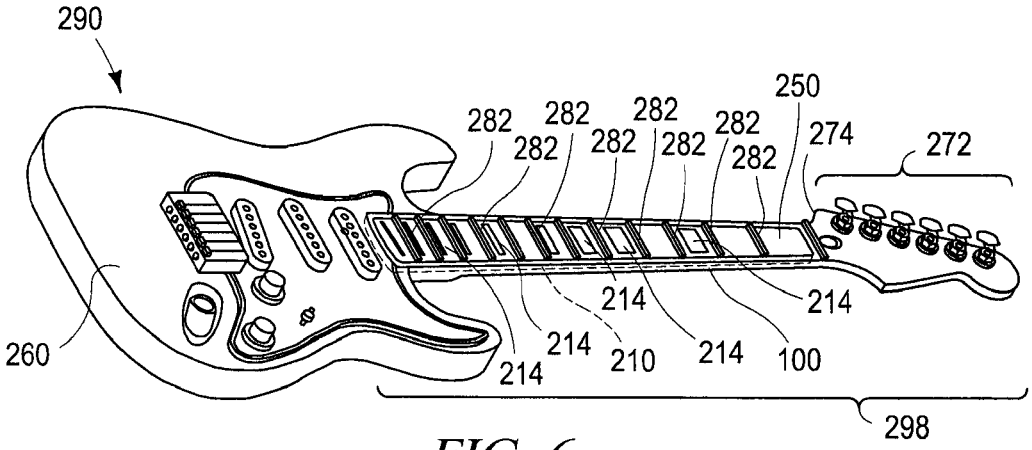
FIG. 6 illustrates a guitar with a neck having an inlay for a fretboard made in accordance with FIGS. 3*a*-3*f* and 5*a*-5*h*.

FIG. 6 shows guitar 290 incorporating neck 298 made using the process shown in FIGS. 3*a*-3*f* and 5*a*-5*h*. Neck 298 is joined to body 260 and includes headstock 272, nut 274, and fretboard 250. Fretboard 250 is mounted in cavity 210 formed in neck back 100 with an exposed surface of the fretboard oriented away from the neck back. Islands 214 formed in cavity 210 are disposed in openings within fretboard 250. In one embodiment, islands 214 and neck back 100 comprise the same material. In one embodiment, islands 214 have an exposed surface flush with an exposed surface of fretboard 250. Sidewalls of cavity 110 encompass fretboard 250. A surface of neck back 100 at the periphery of cavity 210 is flush with the exposed surface of fretboard 250. Frets 282 are mounted on fretboard 250. In an alternative embodiment, fretboard 250 is devoid of frets. In one embodiment, frets 282 span the entire width of neck 298. In an alternative embodiment, frets 282 span no more than the width of fretboard 250. By carefully selecting, preparing and forming the materials used in neck back 100 and fretboard 250 and by precision shaping of fretboard 250 and cavity 210, neck 298 made using the method of FIGS. 3*a*-3*f* and 5*a*-5*h* does not have a visible gap between the neck back, fretboard, and islands 214. Furthermore, neck 298 made using the method of FIGS. 3*a*-3*f* and 5*a*-5*h* has fretboard 250 that does not have a visible edge when viewing the neck from the side. In addition, the method of FIGS. 3*a*-3*f* and 5*a*-5*h* allows the use of materials for fretboard 250 unsuitable for use in a non-inlaid fretboard, for example, materials that lacked the hardness or transverse tensile strength necessary to maintain an exposed edge or corner during use of the guitar, or materials with only one aesthetically-acceptable surface. Furthermore, neck 298 made using the method of FIGS. 3*a*-3*f* and 5*a*-5*h* has islands 214 of material from neck back 100 that are visible within openings formed through fretboard 250. In one embodiment, islands 214 provide additional attachment points for fretboard 250 and enhance the structural and acoustical properties of the fretboard.

Figure 7A:
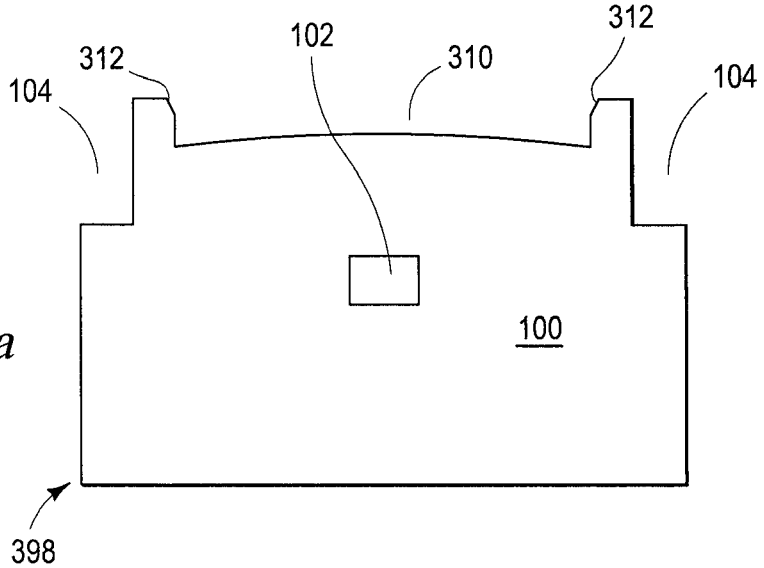
FIGS. 7*a*-7*d* illustrate a process of making a neck having an inlay for a fretboard in accordance with FIGS. 3*a*-3*f.*

FIGS. 7*a*-7*d* in conjunction with FIGS. 3*a*-3*f* show an alternative embodiment of a method of making a stringed musical instrument neck including an inlaid fretboard further including forming the fretboard using a veneer. Continuing from FIG. 3*f*, FIG. 7*a* shows neck 398 including cavity 310 adapted to receive a fretboard. Cavity 310 is formed in neck back 100 using a material removal process such as drilling, routing, milling, rabbeting, chiseling, scraping, sawing, laser cutting, and combinations thereof. In one embodiment, cavity 310 is formed using a high-precision process such as using a CNC or NC milling machine, CNC or NC router, CNC or NC laser cutter, or combinations thereof. Cavity 310 is formed including a transversely curved bottom. In one embodiment, the radius of curvature of the bottom of cavity 310 is similar to the radius of curvature desired for the finished outer surface of the fretboard described below. In one embodiment, neck back 100 includes chamfers 312 formed in sidewalls of cavity 310 and adapted to facilitate inlaying a fretboard into cavity 310 as discussed in detail below. In one embodiment chamfers 312 are formed prior to forming cavity 310 by forming v-shaped grooves in neck back 100 using a process such as carving, chiseling, routing, milling, laser cutting, and combinations thereof. In an alternative embodiment, chamfers 312 are formed while forming cavity 310. In another alternative embodiment, chamfers 312 are formed after forming cavity 310 by using sanding, filing, routing, milling, cutting, laser cutting, or combinations thereof to remove material from sidewalls of the cavity. In one embodiment, cavity 310 includes islands such as shown in FIGS. 5*a*-5*c*.

Figure 7B:
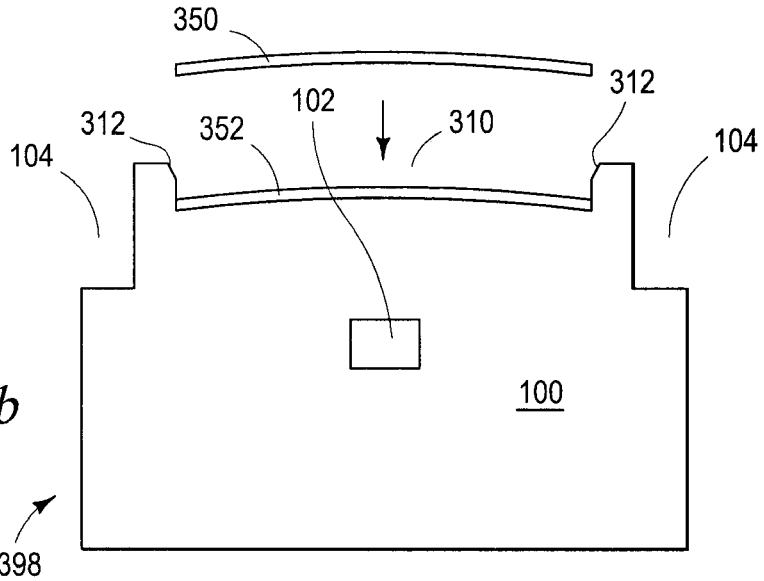

FIG. 7*b* shows fretboard 350 in cross-section view. Fretboard 350 is formed from a thin veneer of a material such as wood, metal, glass, ceramics, polymers, and fiberglass or carbon fiber composites. In an embodiment of fretboard 350 including wood, woods typically used include rosewood, ebony, maple, and pau ferro. In one embodiment, fretboard 350 is formed from a veneer that is less than one hundred twenty five thousandths of an inch thick. In one embodiment, fretboard 350 is formed from a veneer that is twenty thousandths of an inch thick. In another embodiment, fretboard 350 further includes a reinforcing layer joined to the veneer. Fretboard 350 is formed by a process such as planing, shaving, drilling, routing, milling, rabbeting, chiseling, scraping, sawing, sanding, stamping, molding, etching, and combinations thereof. In one embodiment, fretboard 350 is formed using a CNC or NC milling machine, CNC or NC saw, CNC or NC router, CNC or NC water jet, or CNC or NC laser. In one embodiment, fretboard 350 is formed including slots adapted to receive frets. In another embodiment, fretboard 350 includes openings adapted to fit around islands formed in cavity 310. In one embodiment, fretboard 350 is transversely curved prior to being joined to neck back 100. In an alternative embodiment, fretboard 350 is flat prior to being joined to neck back 100.

Fretboard 350 is positioned over neck back 100. An adhesive 352 suitable for joining fretboard 350 to neck back 100 is applied within cavity 310. Alternatively, adhesive 352 is applied to surfaces of fretboard 350 or to both the fretboard and neck back 100. In one embodiment, fretboard 350 and neck back 100 include wood and adhesive 352 includes hide glue, urea-formaldehyde resin, resorcinol-formaldehyde resin, polyvinyl acetate, aliphatic resin emulsion, polyurethane, or epoxy.

Figure 7C:
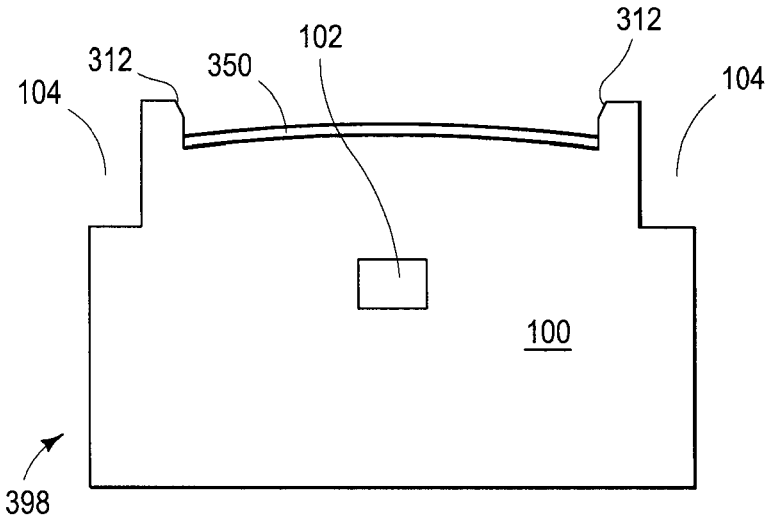

Fretboard 350 and neck back 100 are moved one towards the other, and chamfers 312 help align the fretboard within cavity 310. In one embodiment, portions of neck back 100 surrounding cavity 310 are thin enough to deform so as to facilitate the entry of fretboard 350 into the cavity. Fretboard 350 is disposed within cavity 310 in contact with the bottom and sides of the cavity, as shown in FIG. 7*c*. In one embodiment, fretboard 350 conforms to the bottom surface of cavity 310. In one embodiment, fretboard 350 and neck back 100 are held together by bands, clamps, or other means while adhesive 352 sets or cures, and the bands, clamps, or other means are removed after the adhesive obtains sufficient bond strength. In one embodiment, fretboard 350 has a different moisture content than neck back 100 when the fretboard and neck back are joined so that the fretboard will subsequently swell or the neck back subsequently shrinks so that the fretboard more precisely fills cavity 310. In another embodiment, fretboard 350 has a different temperature than neck back 100 when the fretboard and neck back are joined so that the fretboard will subsequently expand or the neck back subsequently shrinks so that the fretboard more precisely fills cavity 310.

Figure 7D:
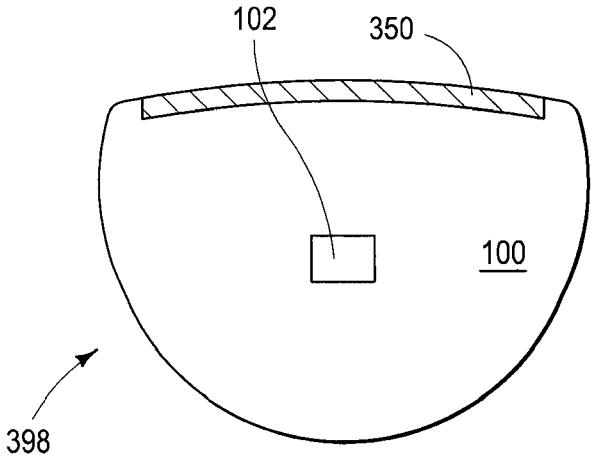

FIG. 7*d* shows a cross-section of neck 398 after further shaping of the neck. Neck back 100 is shaped into a finished profile by a material removal process such as planning, drilling, routing, milling, rabbeting, chiseling, scraping, sawing, sanding, and combinations thereof. Chamfers 312 are eliminated while fretboard 350 and adjacent portions of neck back 100 are shaped into a suitably radiused surface by a material removal process such as milling, chiseling, scraping, sawing, sanding, and combinations thereof. In one embodiment, grooves for frets are formed in fretboard 350 using a CNC or NC end mill, router, or laser cutting system after joining the fretboard to neck back 100. In one embodiment, neck 398 or portions thereof are given a surface coating or finish appropriate to the materials used.

A guitar incorporating neck 398 made by the process shown in FIGS. 3*a*-3*f* and 7*a*-7*d* can appear identical to a guitar made by the process shown in FIGS. 3*a*-3*r* such as shown in FIG. 4. Alternatively, a guitar incorporating neck 398 made by the process shown in FIGS. 3*a*-3*f* and 7*a*-7*d* and further including islands in neck back 100 and corresponding openings in fretboard 350 can appear identical to a guitar made by the process shown in FIGS. 3*a*-3*f* and 5*a*-5*g* such as shown in FIG. 6.

By carefully selecting, preparing and forming the materials used in neck back 100 and fretboard 350 and by precision shaping of fretboard 350 and cavity 310, neck 398 made using the method of FIGS. 3*a*-3*f* and 7*a*-7*d* does not have a visible gap between the neck back, fretboard, and islands if present. Furthermore, neck 398 made using the method of FIGS. 3*a*-3*f* and 7*a*-7*d* has fretboard 350 that does not have a visible edge when viewing the neck from the side. In addition, the method of FIGS. 3*a*-3*f* and 7*a*-7*d* allows the use of materials for fretboard 350 unsuitable for use in a non-inlaid fretboard, for example, materials that lacked the hardness or transverse tensile strength necessary to maintain an exposed edge or corner during use of the guitar, or materials with only one aesthetically-acceptable surface. In particular, the method shown in FIGS. 3*a*-3*f* and 7*a*-7*d* allow the use of thinner materials including natural materials that are readily available only in thinner pieces and artificial materials that are prohibitively expensive unless the material is thin. Furthermore, neck 398 made using the method of FIGS. 3*a*-3*f* and 7*a*-7*d* can include islands of material from neck back 100 visible as insets within openings formed through fretboard 350. In one embodiment, the islands provide additional attachment points for fretboard 350 and enhance the structural and acoustical properties of the fretboard.

While one or more embodiments of the present invention have been illustrated in detail, the skilled artisan will appreciate that modifications and adaptations to those embodiments may be made without departing from the scope of the present invention as set forth in the following claims.

What is claimed is:

1. A method of making a stringed musical instrument, comprising:

providing a neck;

forming a cavity in the neck;

forming a fretboard adapted to fit the cavity; and mounting the fretboard within the cavity by flexing a sidewall of the cavity.

2. The method of claim 1, further including:

forming the cavity while leaving a portion of the neck as an island in the cavity; and forming an opening in the fretboard adapted to accommodate the island.

3. The method of claim 1, further including forming a chamfer in a sidewall of the cavity.

4. The method of claim 1, further including mounting the fretboard within the cavity such that an edge of the fretboard contacts a sidewall of the cavity without a visible gap.

5. The method of claim 1, further including forming a curved bottom surface in the cavity.

6. The method of claim 1, further including forming the fretboard comprising a veneer.

7. The method of claim 1, further including forming the cavity or fretboard using a computer-controlled (CNC) or numerically-controlled (NC) milling machine, router, water jet, or laser.

8. The method of claim 1, further including mounting the fretboard to include a surface of the fretboard flush with a surface of the neck.

9. A neck for a stringed musical instrument, comprising:

a cavity formed in the neck; and a fretboard disposed within the cavity and including an opening formed in the fretboard with a portion of the neck disposed within the opening in the fretboard.

10. The neck of claim 9, wherein the fretboard is encompassed by sidewalls of the cavity.

11. The neck of claim 9, wherein a surface of the neck is flush with a surface of the fretboard.

12. The neck of claim 9, wherein an edge of the fretboard contacts a sidewall of the cavity.

13. The neck of claim 9, wherein the fretboard further includes a veneer.

14. The neck of claim 9, wherein the cavity includes a chamfer.

* * * * *